US009125791B2

(12) United States Patent
Collins

(10) Patent No.: US 9,125,791 B2
(45) Date of Patent: Sep. 8, 2015

(54) MASSAGE APPARATUS

(76) Inventor: Burke Collins, Tampa, FL (US)

( * ) Notice: Subject to any disclaimer, the term of this patent is extended or adjusted under 35 U.S.C. 154(b) by 431 days.

(21) Appl. No.: 13/056,866

(22) PCT Filed: Jul. 31, 2009

(86) PCT No.: PCT/US2009/052446

§ 371 (c)(1),
(2), (4) Date: Jan. 31, 2011

(87) PCT Pub. No.: WO2010/014927

PCT Pub. Date: Feb. 4, 2010

(65) Prior Publication Data

US 2011/0137218 A1 Jun. 9, 2011

Related U.S. Application Data

(60) Provisional application No. 61/085,531, filed on Aug. 1, 2008.

(51) Int. Cl.
*A61H 15/00* (2006.01)

(52) U.S. Cl.
CPC ..... *A61H 15/00* (2013.01); *A61H 2015/0014* (2013.01); *A61H 2015/0057* (2013.01); *A61H 2205/06* (2013.01); *A61H 2205/10* (2013.01)

(58) Field of Classification Search
CPC . A61H 7/001; A61H 2007/009; A61H 1/006; A61H 1/008; A61H 2015/0007; A61H 2015/0057; A61H 2205/081; A61H 2205/083; A61H 2205/084; A61H 2201/0192; A61H 2201/1623; A61H 2201/1626; A61H 15/00; A61H 2015/0014; A61H 2205/06; A61H 2205/10
USPC ..... 601/122–127, 133–135, 140, 84, 97, 601/103, 128, 132; 606/204–204.55, 206
See application file for complete search history.

(56) References Cited

U.S. PATENT DOCUMENTS

| | | | | | |
|---|---|---|---|---|---|
| 285,160 | A | * | 9/1883 | Rice | 601/133 |
| 613,859 | A | * | 11/1898 | Hickey | 601/136 |
| 908,256 | A | * | 12/1908 | Harrison | 24/514 |
| 1,978,223 | A | * | 10/1934 | Parker | 606/239 |
| 2,128,790 | A | * | 8/1938 | Barbour | 601/101 |
| 2,959,167 | A | * | 11/1960 | Leclabart | 601/133 |
| 3,374,784 | A | * | 3/1968 | Brent et al. | 601/133 |
| 3,857,336 | A | * | 12/1974 | Nunlist et al. | 100/269.16 |
| 4,718,408 | A | * | 1/1988 | Barreiro | 601/99 |
| 5,421,799 | A | | 6/1995 | Rabin et al. | |
| 5,484,390 | A | * | 1/1996 | Chiang | 601/133 |
| 5,730,708 | A | * | 3/1998 | Spratt | 601/118 |
| 5,769,758 | A | * | 6/1998 | Sarkinen | 482/44 |
| 5,792,081 | A | | 8/1998 | Cross | |

(Continued)

*Primary Examiner* — Valerie L Skorupa
(74) *Attorney, Agent, or Firm* — Cozen O'Connor

(57) ABSTRACT

A massage apparatus includes a base plate, a first tension plate affixed to a first end to the base plate, a second tension plate affixed at a second end of the base plate opposite the first tension plate, a first massaging element coupled to the first tension plate remote from the base plate; a second massage element coupled to the second tension plate remote from the base plate facing the first massaging element, and a variable adjuster configured to vary at least one of a distance between the first and the second massage elements and a pressure applied by the massage elements. The variable adjuster is configured so that the pressure applied by the massage elements is adjustable given any distance between the first and the second massage elements.

12 Claims, 19 Drawing Sheets

(56) References Cited

U.S. PATENT DOCUMENTS

| | | | | |
|---|---|---|---|---|
| 6,190,339 | B1 * | 2/2001 | Imazaike et al. | 601/133 |
| 6,332,873 | B1 * | 12/2001 | Naruse et al. | 601/135 |
| 6,494,851 | B1 * | 12/2002 | Becher | 601/133 |
| 7,399,287 | B2 * | 7/2008 | Meisch | 601/137 |
| 2003/0195558 | A1 * | 10/2003 | Curtis | 606/201 |
| 2003/0225349 | A1 | 12/2003 | Hepburn et al. | |
| 2004/0215115 | A1 * | 10/2004 | Sheen | 601/135 |
| 2010/0094183 | A1 * | 4/2010 | Golombek | 601/112 |

* cited by examiner

MASSAGE APPARATUS

PRIORITY CLAIM

This is a U.S. national stage of Application No. PCT/US2009/52446, filed on Jul. 31, 2009, which claims priority to U.S. Provisional Patent Application No. 61/085,531, filed on Aug. 1, 2008, the contents of which are incorporated herein by reference.

BACKGROUND OF THE INVENTION

1. Field of the Invention

Disclosed is a system for preventing and treating repetitive stress injuries (RSI) and muscle and tendon pain.

2. Description of the related art

It is known to provide apparatuses for massaging body parts. However, many of these prior art apparatuses are not effective in treating repetitive stress injuries and muscle and tendon pain. Many prior art devices do not provide constant pressure nor do they provide pressure adjustments that are objective and reproducible at every therapy session.

SUMMARY OF THE INVENTION

The disclosed massaging apparatus is for treating repetitive stress injuries and muscle and tendon pain. The massaging apparatus is manufactured using very few parts. It is also simple to adjust and use. The present apparatus is beneficial over the prior art in that it is easy to manufacture, assemble, and use. In particular, a minimum number of parts provides for increased manufacturability, reduced cost, and ease of use. Additionally, the disclosed apparatus is preferably portable.

The apparatus is designed to reduce localized muscle tension and/or muscle tightness and/or muscle pain (i.e. myofascial pain). The apparatus is also adapted to release musculoskeletal trigger points and break down collagenous adhesions. The material of the roller wheels aids in the operation of the apparatus.

The apparatus provides for improved healing rates for tendon and ligament strains. In cases where tissue ischemic is present, the apparatus increases blood flow to muscles having restricted range of motion. Additionally, the present apparatus is useful in the treatment of repetitive stress injuries in industrial, office, home, and sports settings.

In a preferred configuration, the above apparatus accomplishes its objectives when the compression rolling effect of the roller wheels induces collagen and elastin remodeling and fibroblast production.

According to one embodiment of the invention, the massage apparatus comprises a base plate, a first tension plate affixed to a first end to the base plate, a second tension plate affixed at a second end of the base plate opposite the first tension plate, a first massaging element coupled to the first tension plate remote from the base plate; a second massage element coupled to the second tension plate remote from the base plate facing the first massaging element, and a variable adjuster configured to vary at least one of a distance between the first and the second massage elements and a pressure applied by the massage elements. The variable adjuster is configured so that the pressure applied by the massage elements is adjustable given any distance between the first and the second massage elements.

DETAILED DESCRIPTION OF THE PRESENTLY PREFERRED EMBODIMENTS

Figure 1:
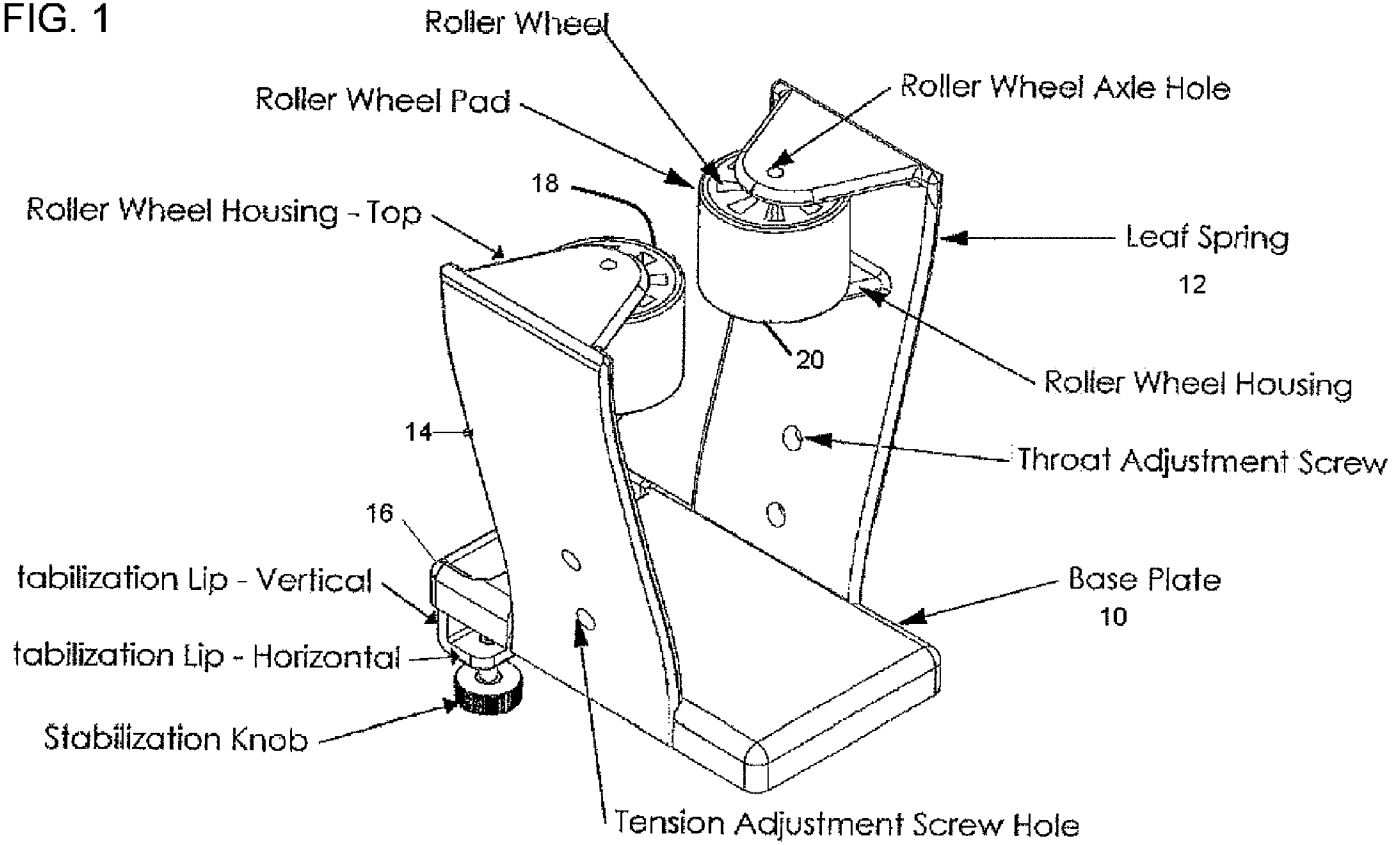
FIG. 1 is a partial perspective view of a massage apparatus according to one embodiment of the invention.

Disclosed is a massage apparatus that is easy to use and adaptable to different massage techniques. A basic principle of operation of the massage apparatus is the use of a cantilevered leaf spring design to apply tension to the area of the body to be massaged. This cantilevered leaf spring design provides for ease of use and set-up. In a preferred embodiment, there is a base plate, which can be metal, wood, Teflon, plastic, polycarbonate, nylon, or the like, and two tension plates that extend from the base plate in a substantially perpendicular manner. In a preferred embodiment, these tension plates are polycarbonate, however, any suitable material such as metal, plastic, wood, nylon, or the like can be used. In one embodiment, the base and vertically extending plates are molded as a single body. In another embodiment, the base and vertically extending plates are molded as integral or separate parts. The vertically extending plates are then attached to the base plate by snapping, clipping, screwing, gluing, or the like.

A massage wheel is affixed to an end of each of the tension plates or leaf springs opposite the base plate. In a preferred embodiment, there is one massage wheel on each plate. Other embodiments utilize other numbers of massage wheels. The massage wheels can be firm or soft depending on the application or treatment protocol.

In one embodiment, there are two adjustment screws. A first adjustment screw adjusts the spacing between of the two massage wheels via a throat width adjustment knob. The second screw adjusts the tension applied by the massage wheels via a therapeutic pressure adjustment knob. In a preferred embodiment, markings denote the tension to be applied. In another embodiment, a gauge is provided to measure the applied tension during use. Alternatively, each massage wheel has one or more adjustments to adjust spacing and tension. The adjustable tension provides for ease of compliance to protocol. Additionally, an indicator of applied force provides real time feedback to the patient as well as denoting progress in therapy.

In a preferred embodiment, the clear or translucent nature of the components allows the user to align the body portion to be massaged. This results in better performance and an increase in compliance to protocol and repeatability.

It should be noted that the adjustability of the apparatus enabled the apparatus to massage any body part. This adjustment can be made using the width adjustment screw. Additionally, the base plate can be extended and/or various sized wheels can be used to vary the spacing between the massage wheels and the pressure applied by the massage wheels. In a preferred embodiment, an adjustment scale is associated with each of the adjustment knobs.

The wheel spacing and tension are easily and continuously adjustable. In one embodiment, a controller is used that senses applied tension and adjusts the tension automatically and continuously according to a preset profile.

The apparatus is simple to use and can be used on the arms, legs, hands, feet or the like. In a preferred embodiment, the user sets both the tension and massage wheel spacing and moves the limb to be massaged between the massage wheels. It is noted that the user does not have to apply the pressure during use. The apparatus provides the appropriate pressure based on the preset tension. In this manner, the user gets the maximum benefit. In prior devices that rely on the user to manually apply the massaging pressure, if there were any pain during use, the user would naturally reduce the applied force, thereby minimizing the effectiveness of the apparatus. The present apparatus is more effective because tension or force is applied automatically.

In one embodiment, roller-blade style wheels are provided as the massage wheels. In another embodiment, roller wheels with a ⅛" foam covering are utilized. In another embodiment, a plurality of wheels is used for each roller wheel element.

As shown in FIG. 1, a massage apparatus includes a base plate 10 having two substantially vertically extending leaf springs 12, 14. In this first embodiment, each of the vertically extending leaf springs 12, 14 have at least two corresponding holes for an adjustment screw. The base plate 10 has a stabilization assembly 16 that includes horizontal and vertical stabilization lips and a stabilization knob. Alternatively, the massage apparatus can be attached to a surface using suction. The stabilization assembly is configured to affix the massage apparatus to an edge of a table. The massage apparatus includes roller wheels 18, 20 that are configured to make physical contact with the body part to be massaged. The roller wheels are preferably attached to respective leaf springs in a roller wheel housing.

Figure 2:
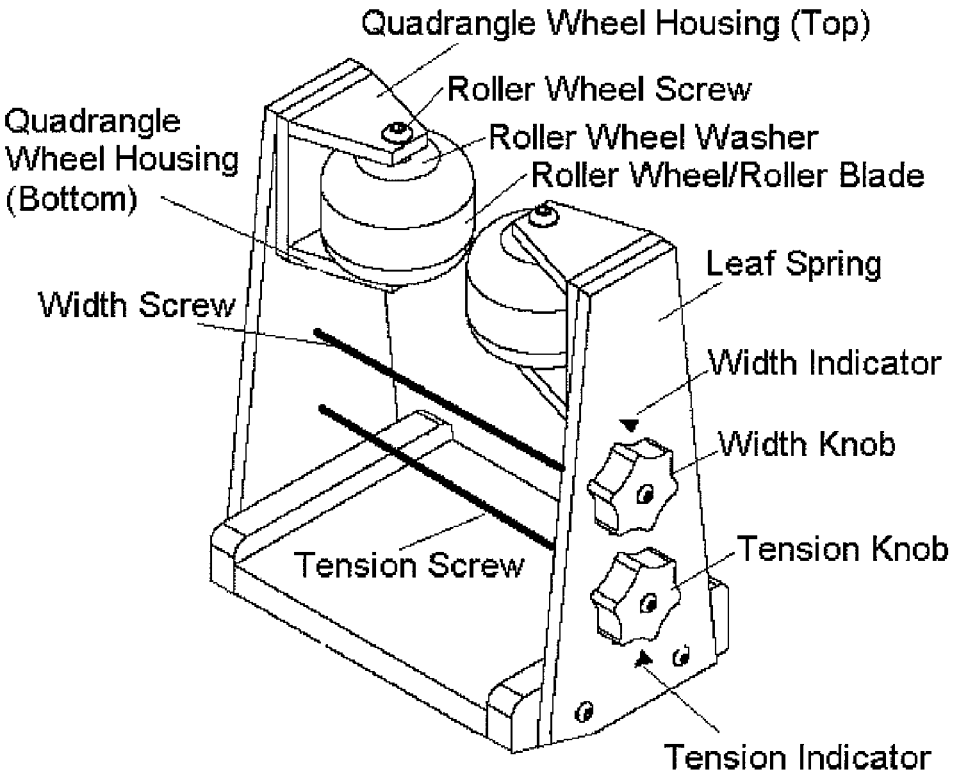
FIG. 2 is a perspective view of a massage apparatus according to one embodiment of the invention.

FIG. 2 is another perspective view of the massage apparatus. As shown in FIG. 2, two adjustment screws are provided that very both the distance between the roller wheels and the force the roller wheels apply.

Figure 3:
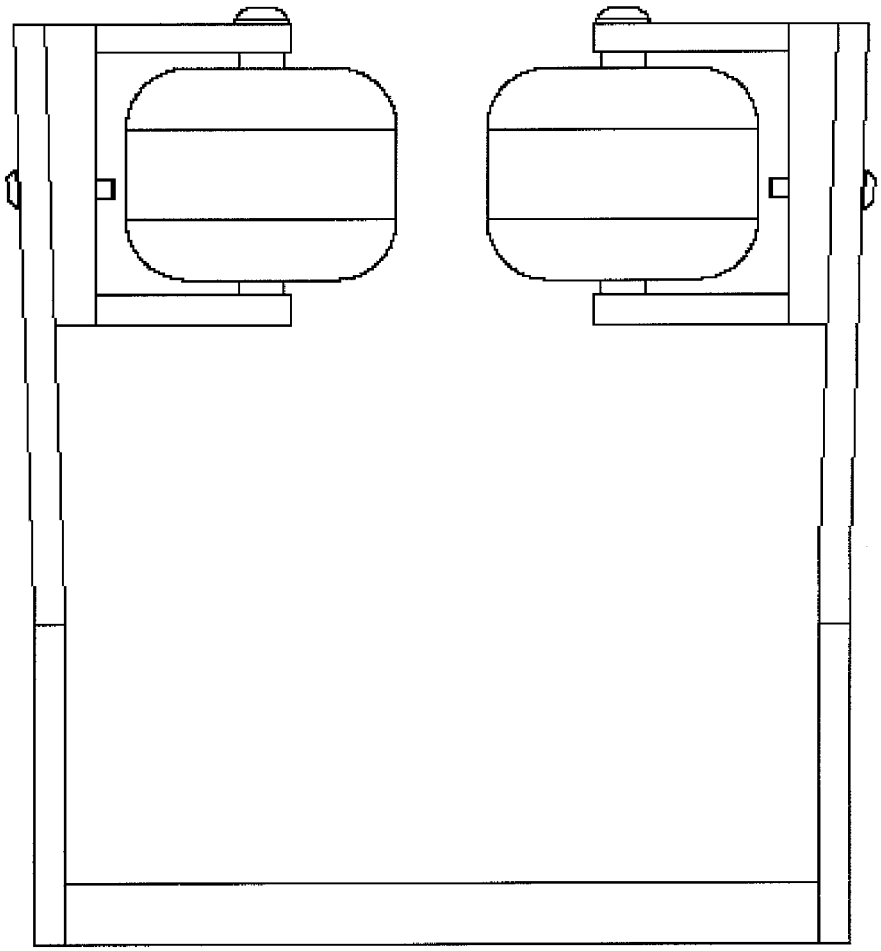
FIG. 3 is a partial front view of a massage apparatus according to one embodiment of the invention.
Figure 4:
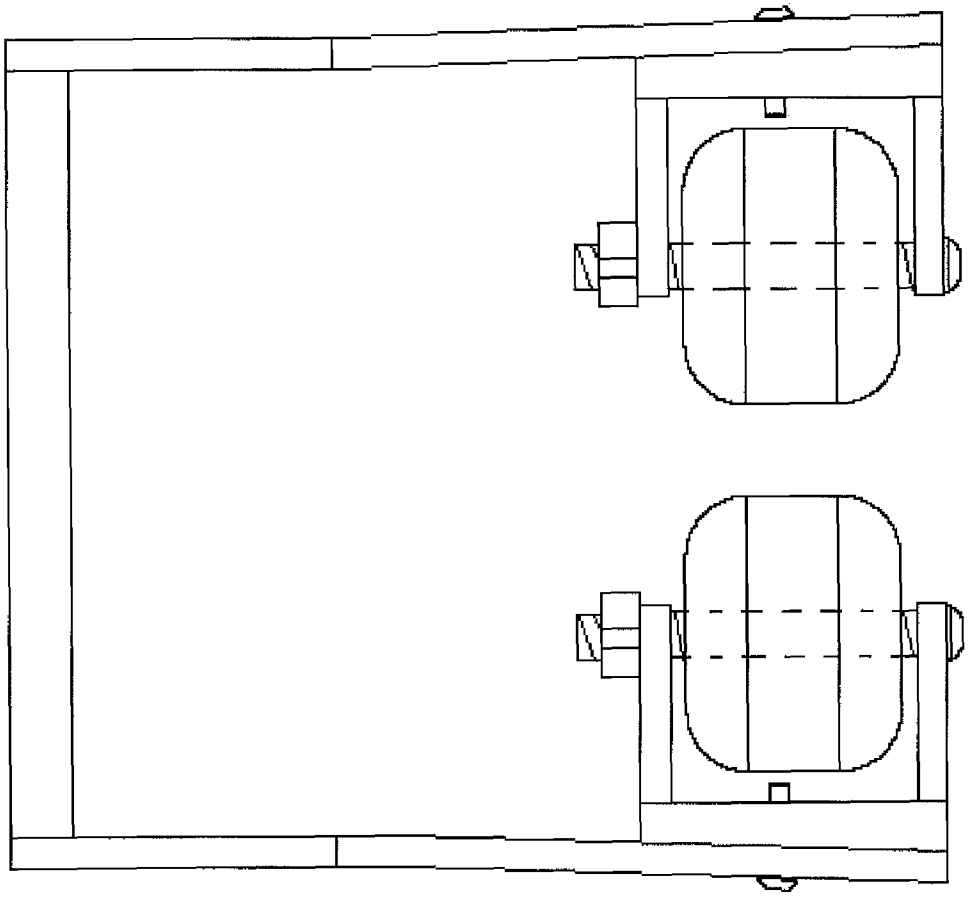
FIG. 4 is a front view of a massage apparatus showing assembly details according to one embodiment of the invention.
Figure 5:
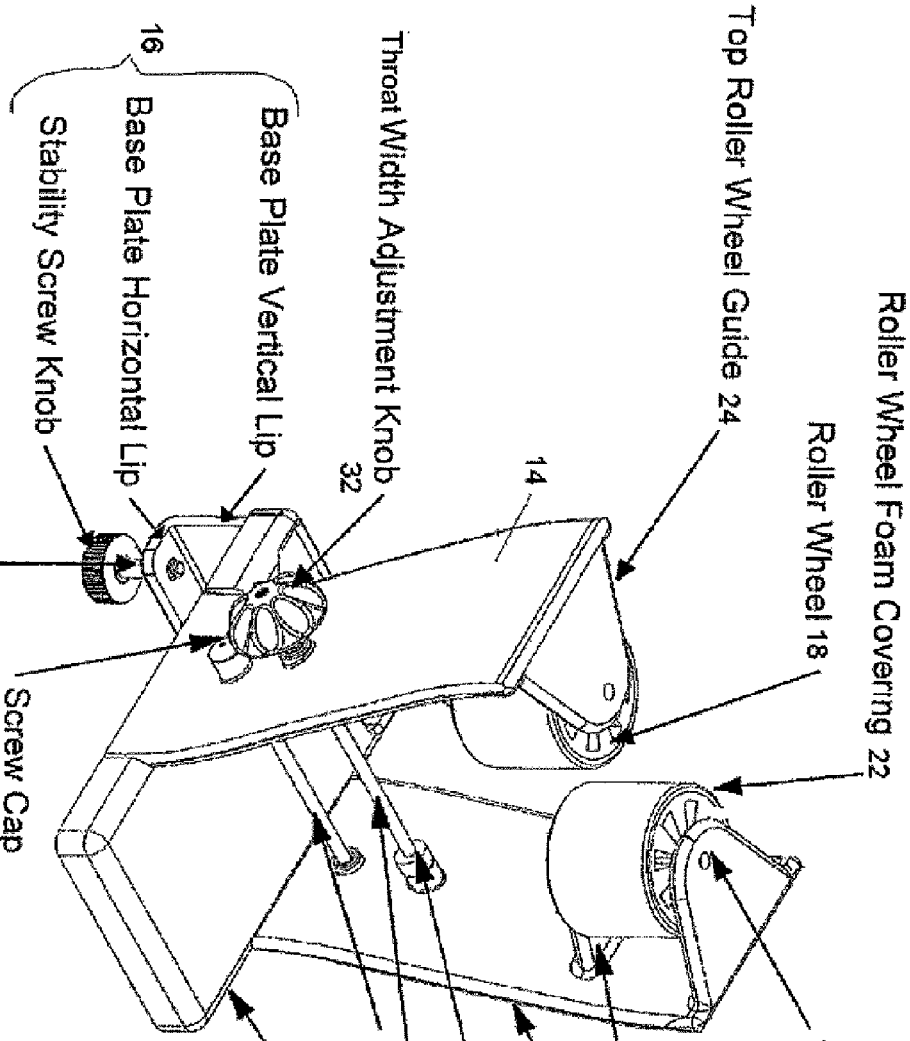
FIG. 5 is a perspective view of a massage apparatus according to one embodiment of the invention.
Figure 6:
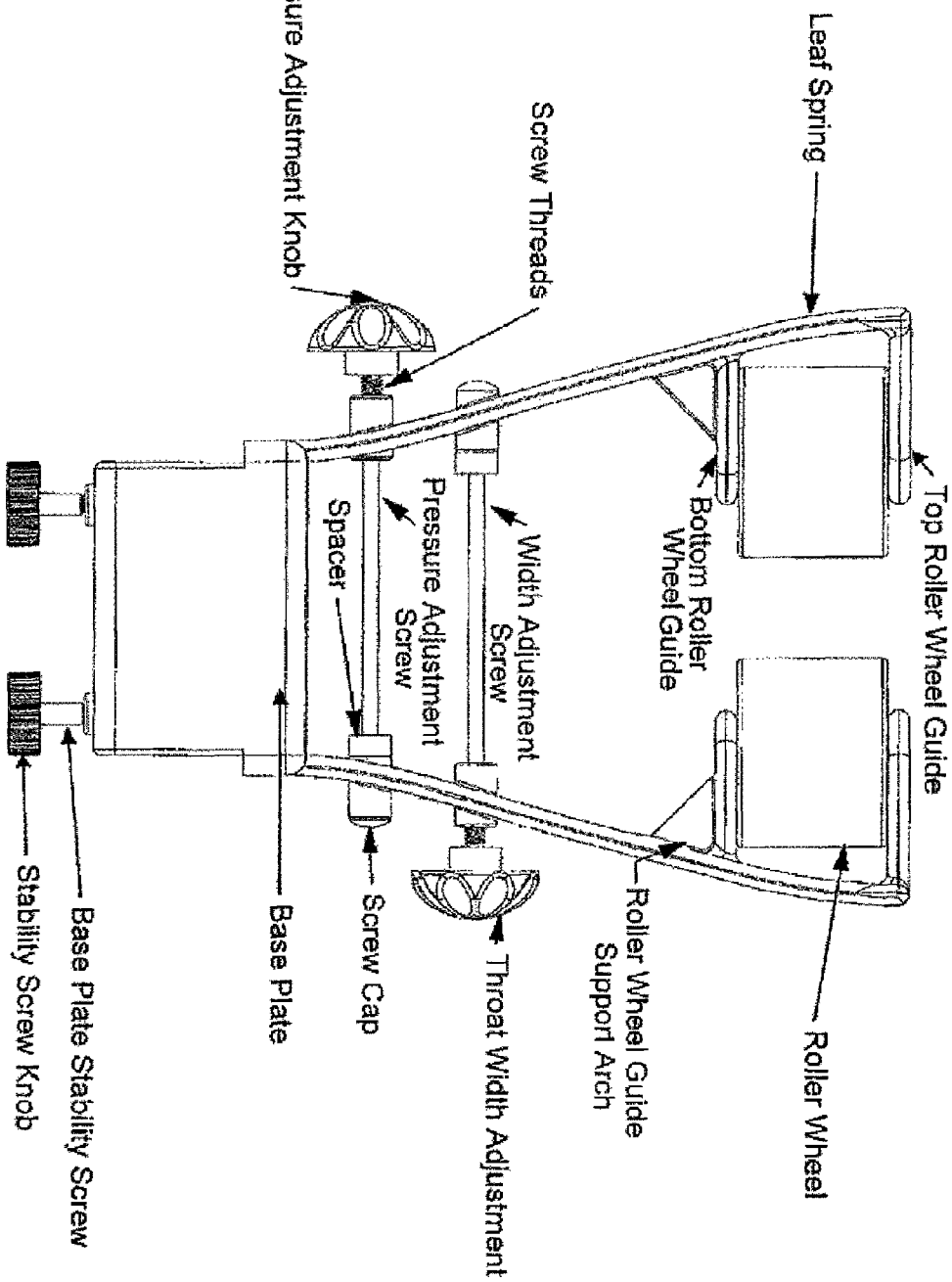
FIG. 6 is a front view of a massage apparatus according to one embodiment of the invention.

FIG. 3 depicts a front view of a portion of the massage apparatus. In a preferred embodiment, the leaf springs each have a first portion that extends perpendicularly from the base plate and a second portion that extends at an angle such that the ends of the leaf springs are spaced wider than the base plate. FIG. 4 shows the respective roller wheels of FIG. 3 attached to the leaf springs with a bolt and nut. FIG. 5 shows a first perspective view of the massage apparatus including width adjustment screw 36 and pressure adjustment screw 38. In a preferred embodiment, a width adjustment knob 32 is provided. Turning the width adjustment knob 32 serves to vary the spacing of the roller wheels 18 and 20. In one embodiment, the roller wheels have a foam covering. As shown, a top roller wheel guide 24 and a bottom roller wheel guide 26 retain the roller wheels. The roller wheels are mounted using an axle mounted in wheel axle pilot hole 30. As shown in FIG. 6, a two pairs of spacers are provided on each adjustment screw to compensate for the angle of the leaf springs.

Figure 7:
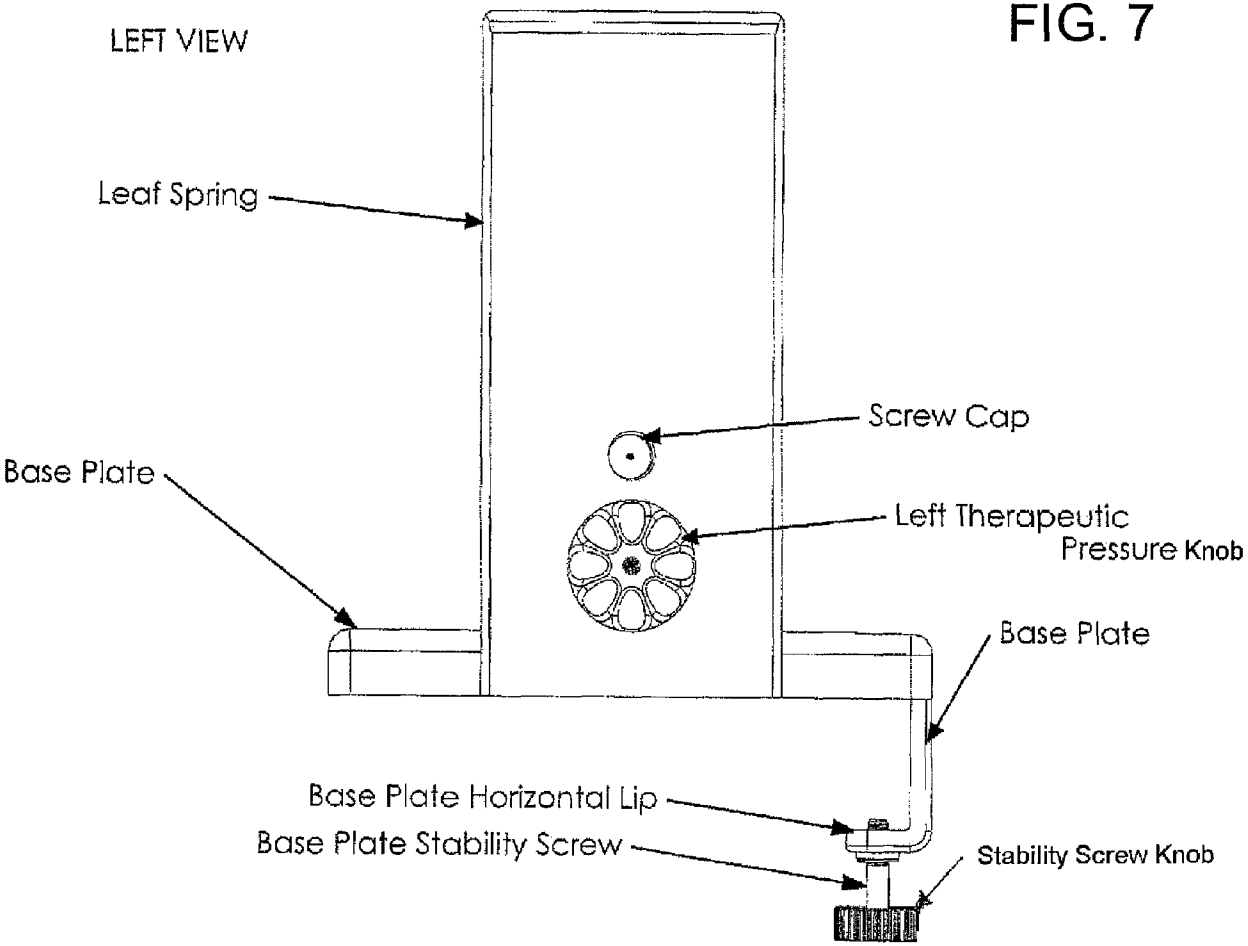
FIG. 7 is a left view of a massage apparatus according to one embodiment of the invention.
Figure 8:
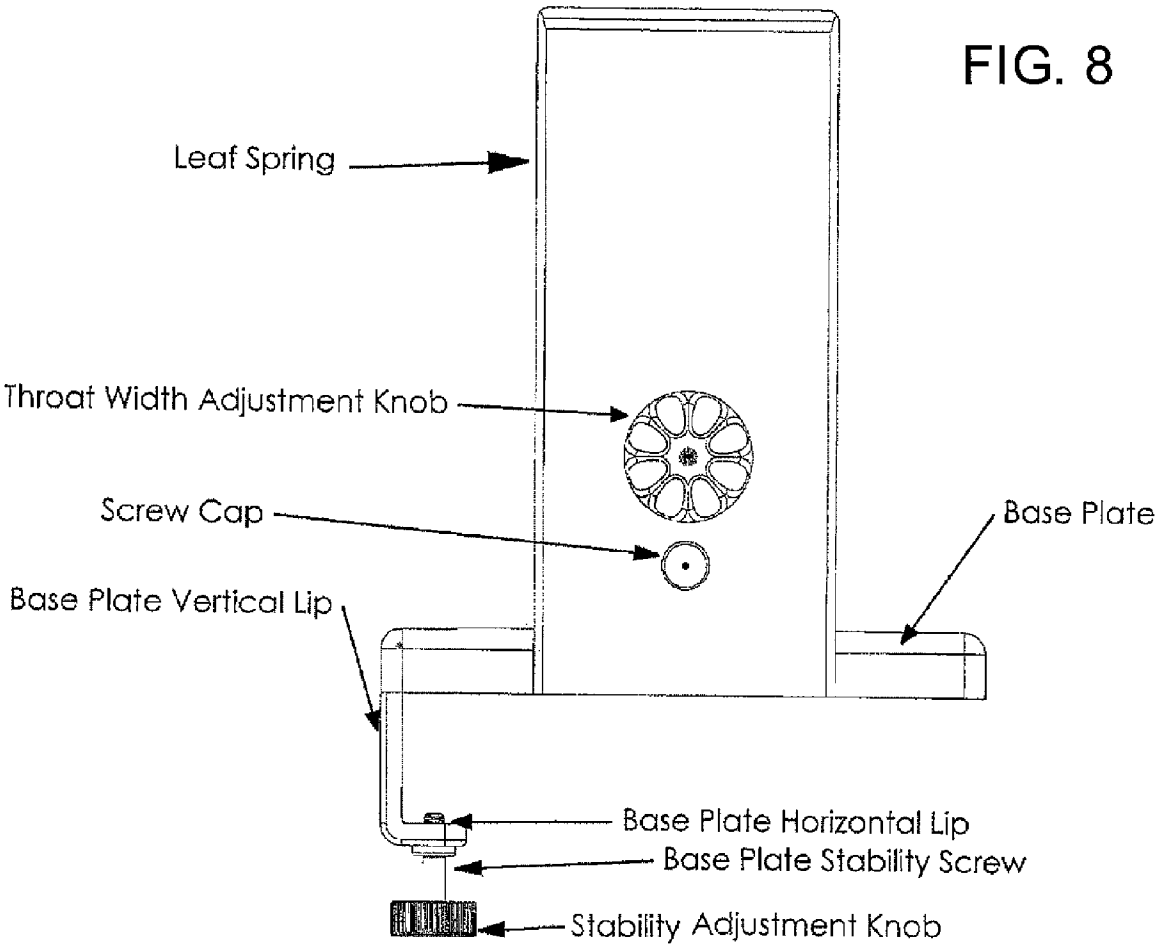
FIG. 8 is a right view of a massage apparatus according to one embodiment of the invention.

FIGS. 7 and 8 are a left and right view of the massage apparatus. In a preferred embodiment, the pressure and width adjustment knobs are provided on opposite sides of the massage apparatus.

Figure 9:
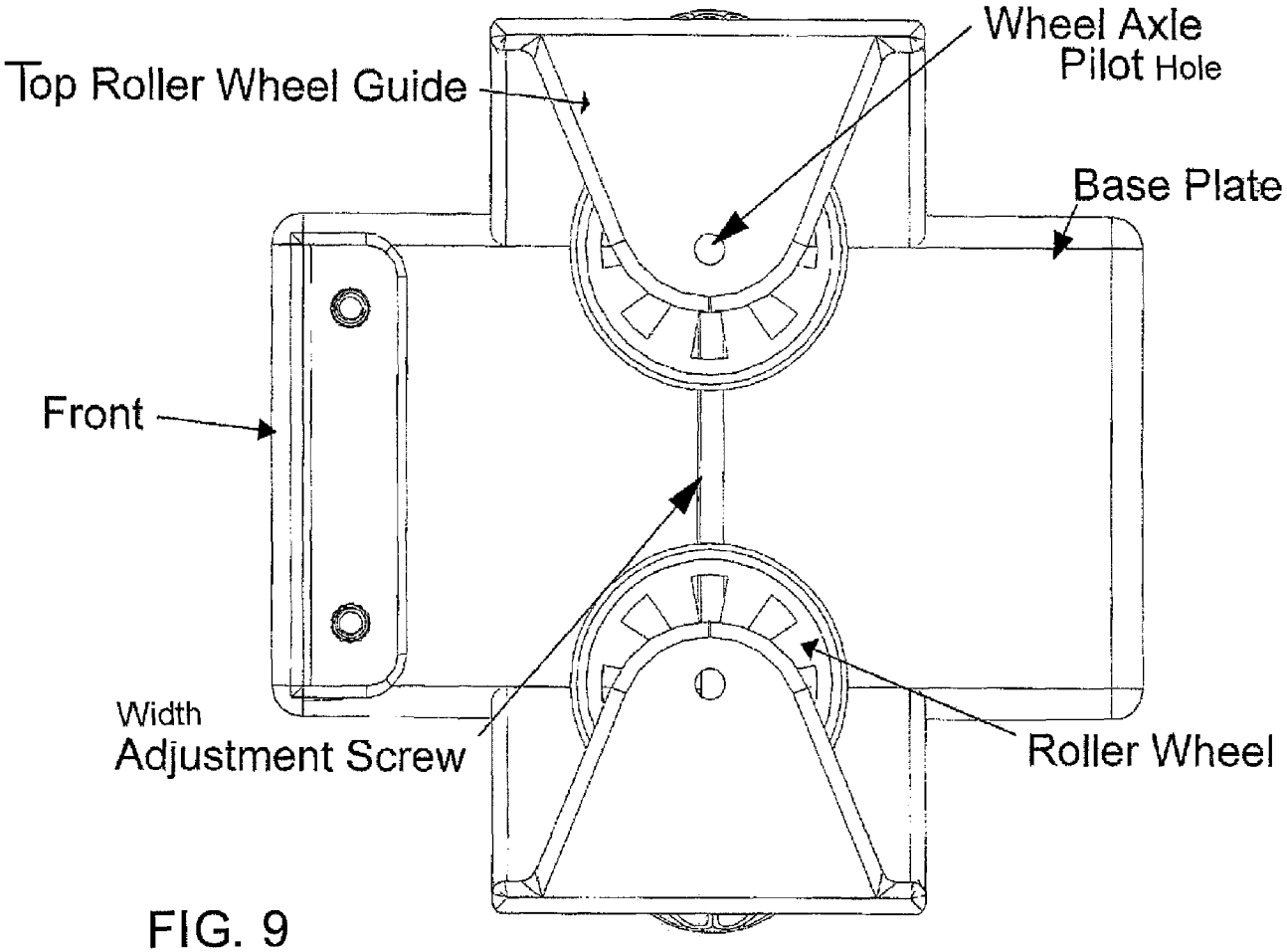
FIG. 9 is a top view of a massage apparatus according to one embodiment of the invention.
Figure 10:
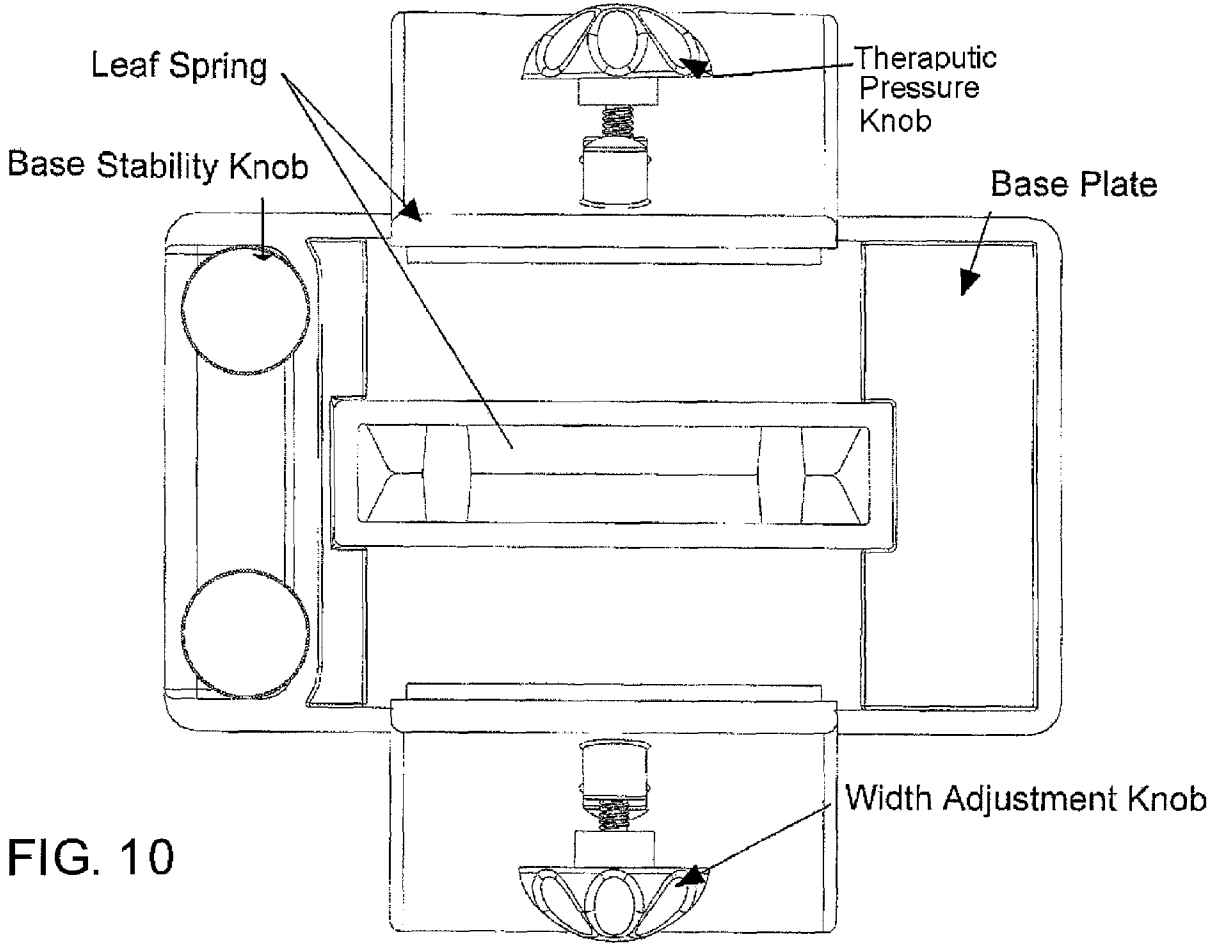
FIG. 10 is a bottom view of a massage apparatus according to one embodiment of the invention.

FIGS. 9 and 10 are a top and bottom view of the massage apparatus. As shown, the contact surfaces of the roller wheels are preferably parallel to each other. In one embodiment, the roller wheels of the massage apparatus are contoured for specific massage or therapeutic applications.

Figure 11:
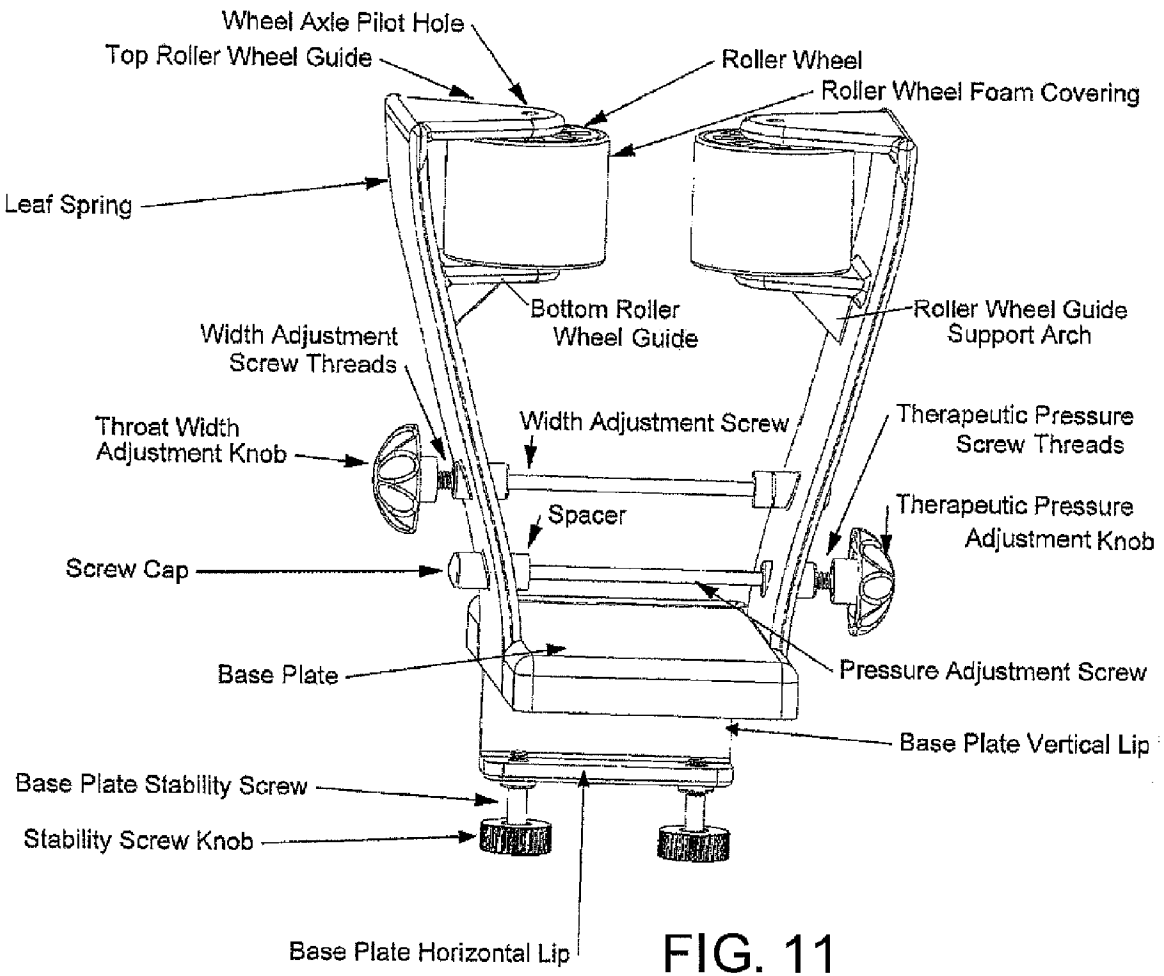
FIG. 11 is a rear view of a massage apparatus according to one embodiment of the invention.

As shown in FIG. 11, in a preferred embodiment, the roller wheels are fixed to their respective leaf spring in upper and lower wheel guides. The lower guides preferably include a roller wheel guide support arch to strengthen the attachment of the roller wheels to the leaf springs.

Figure 12:
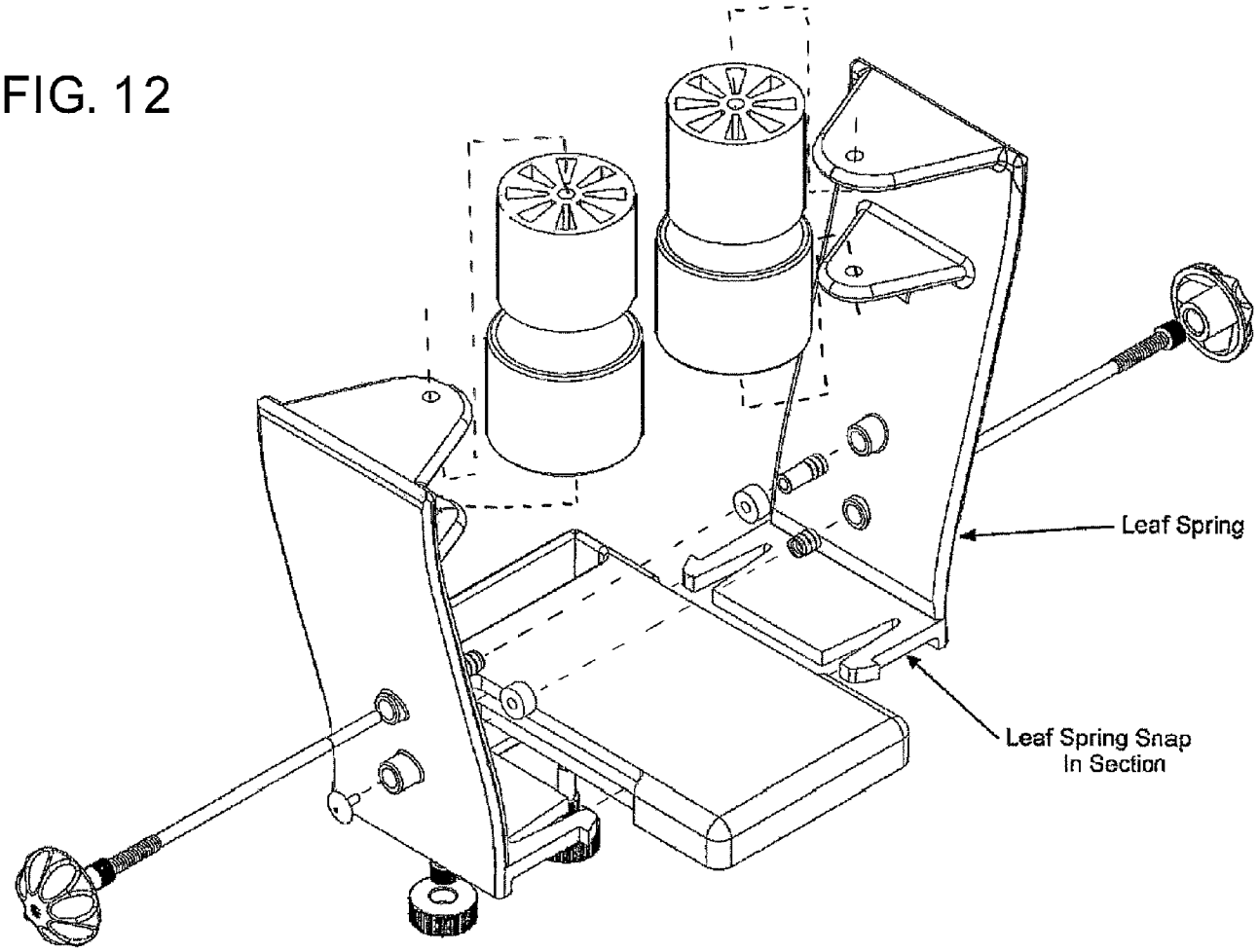
FIG. 12 is an exploded view of a massage apparatus according to the invention.
Figure 13:
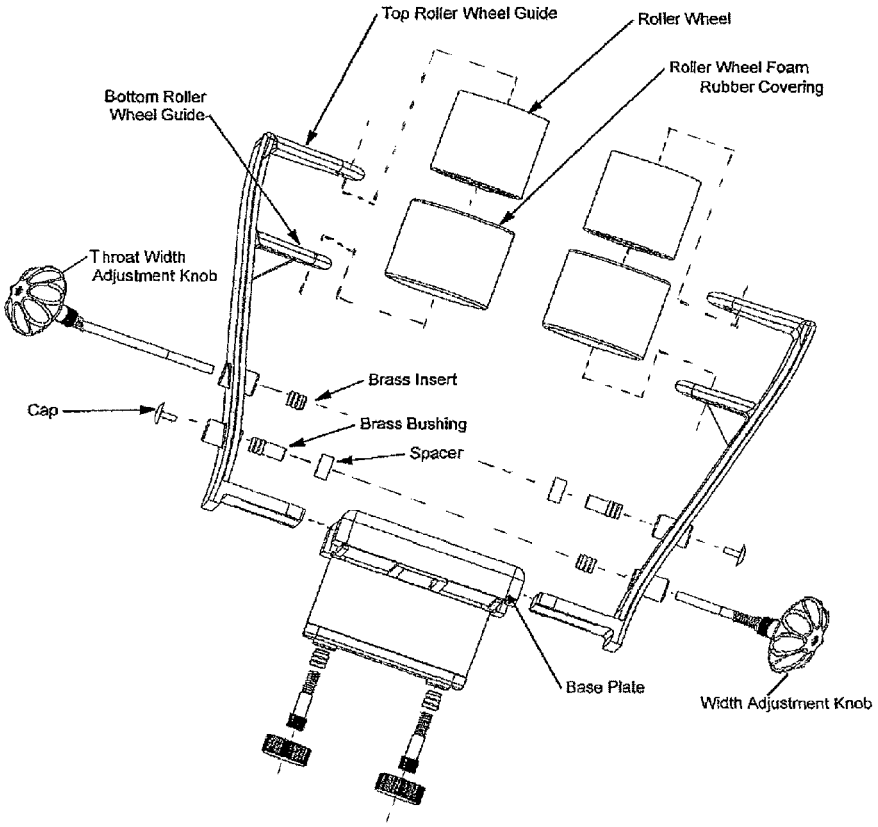
FIG. 13 is an exploded view of a massage apparatus according to the invention.

FIG. 12 is a first exploded view of the massage apparatus. In a preferred embodiment, the leaf springs are molded plastic. Each leaf spring snaps into a receptacle in the base. The components are preferably designed so that they can be shipped in an unassembled state in a minimally sized rectangular package. Preferably, the leaf springs define the overall package dimension. The base roller wheels are configured so that they can be packaged between the leaf springs. As shown in FIG. 13, brass bushings and brass inserts are used where the adjustment screws pass through the leaf springs.

Figure 14A:
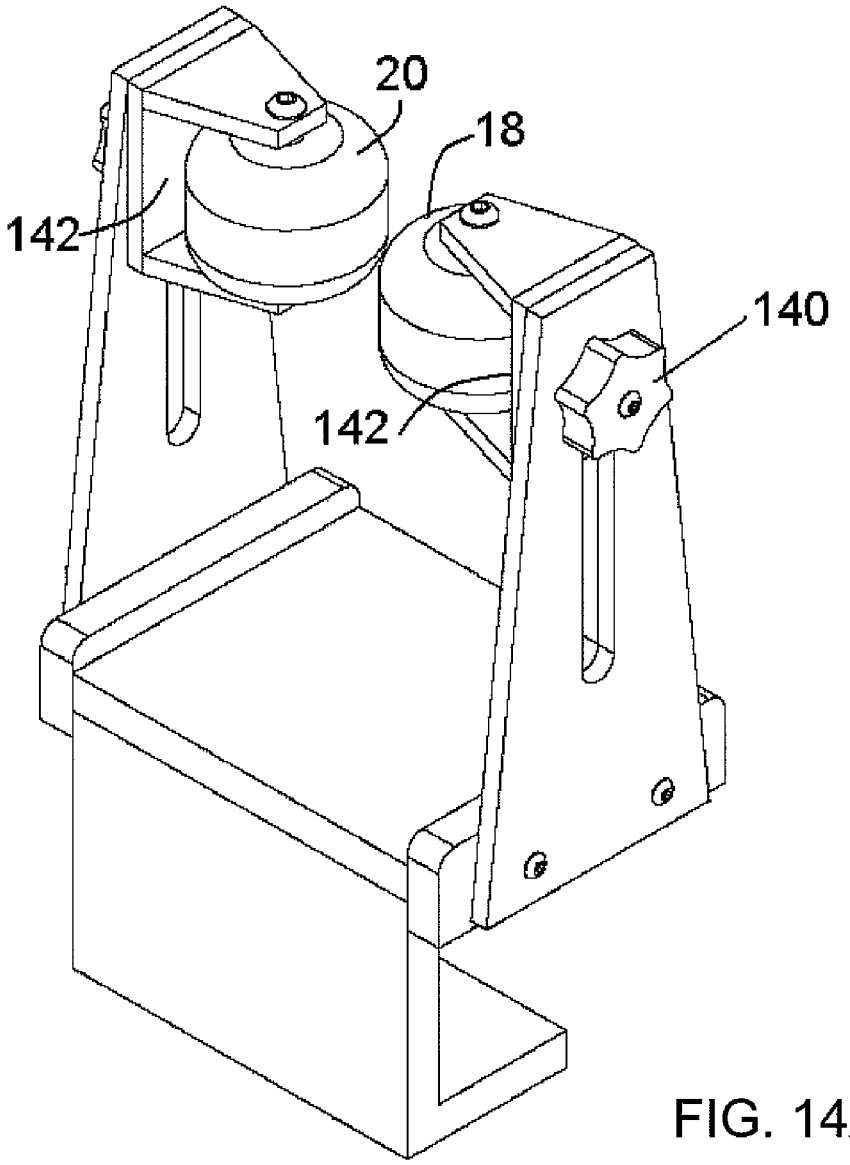
FIGS. 14A-14D are views of a simplified massage apparatus according to one embodiment of the invention.

In a preferred embodiment shown in FIG. 14A, the roller wheels are mounted in a roller wheel housing that is vertically adjustable along the length of the leaf spring. Preferably, a slot is provided in each leaf spring in which the roller wheel housing is adjusted. While FIG. 14 shows the leaf springs without the bend shown in FIG. 1, such a bent leaf spring with an adjustment slot is envisioned.

In use, a user will loosen the roller wheel assembly 142 by turning knob 140. Once the roller wheel assembly 142 is loosened it is repositioned to a given location achieve a desired pressure between the roller wheels 18, 20. Once the roller wheel assembly 142 is repositioned, the wheel assembly knob is tightened to retain it in its given position. Due to the cantilevered design, as the roller wheel assembly 142 is adjusted towards the base of the massage apparatus, the pressure or force between the rollers increases.

Figure 14B:
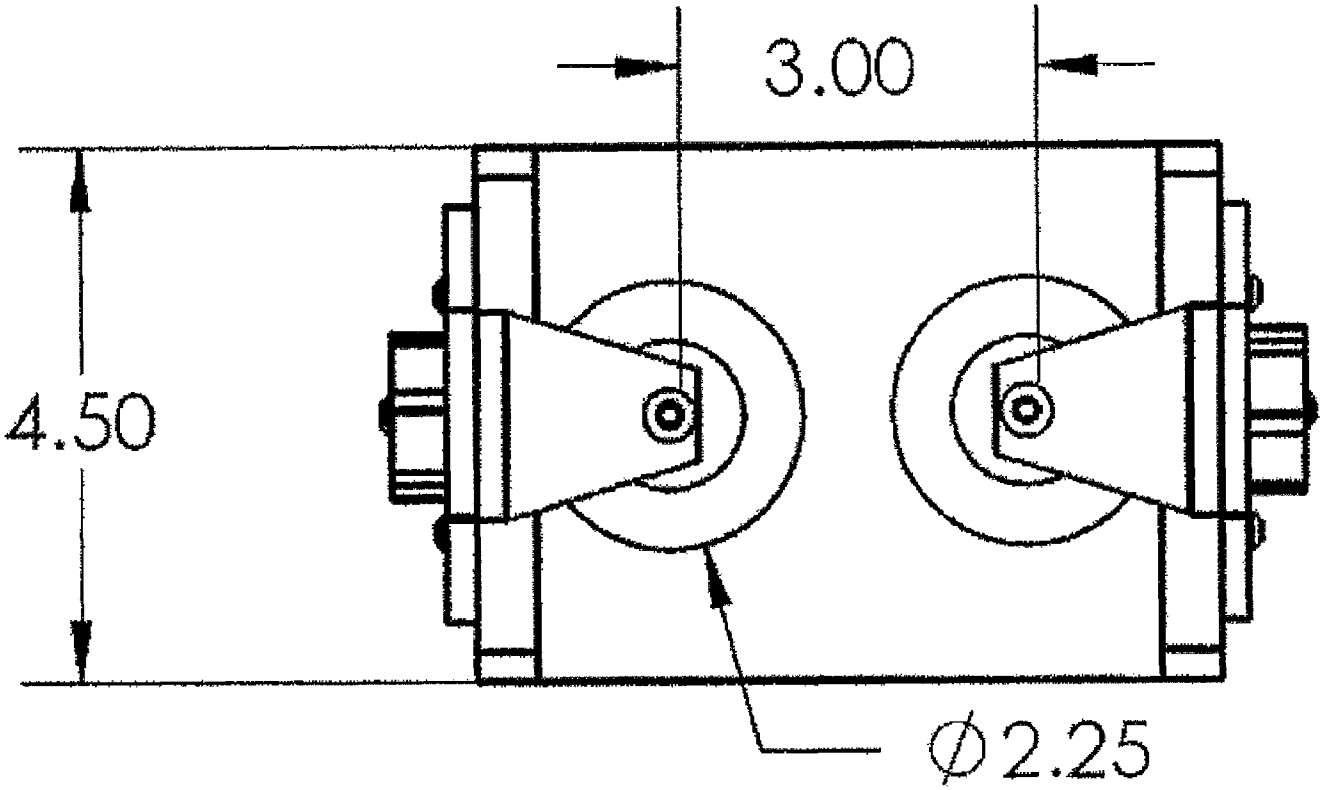
Figure 14C:
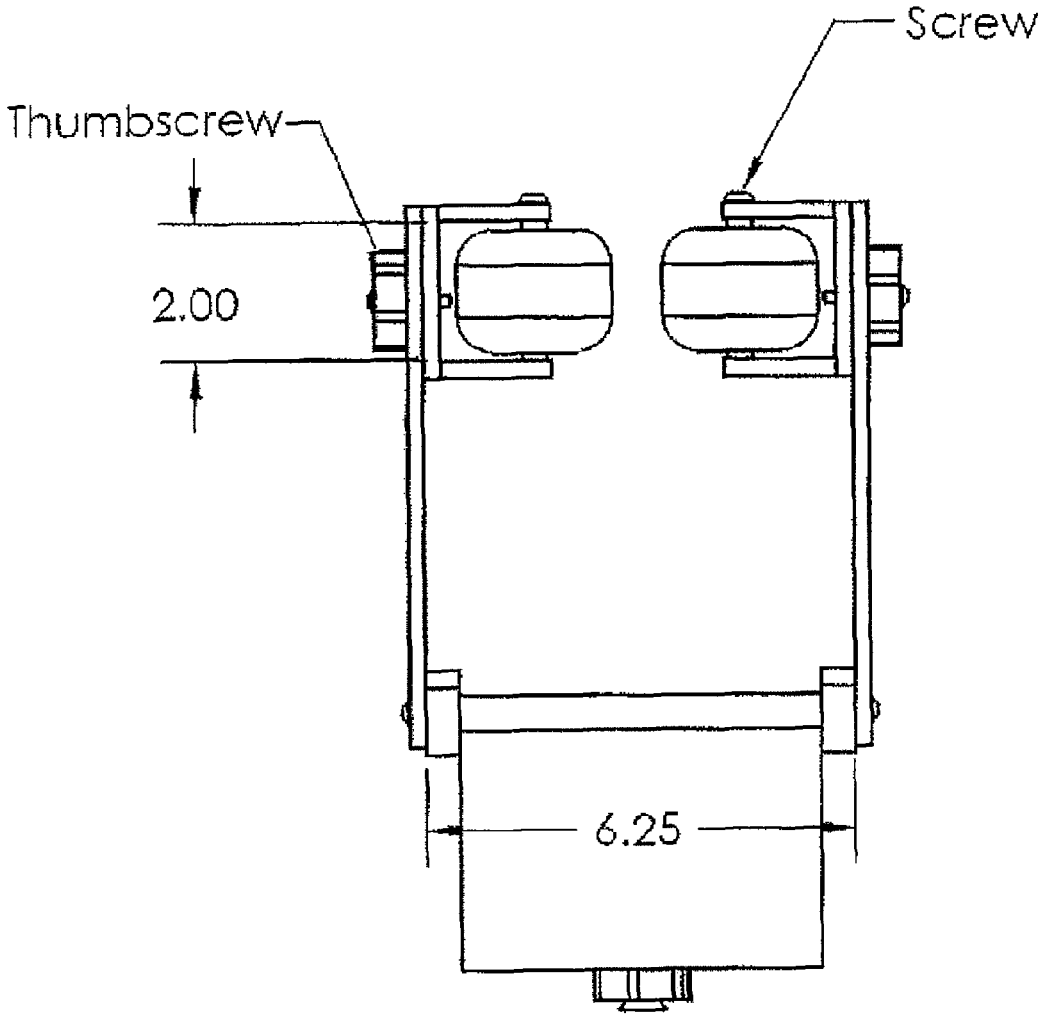
Figure 14D:
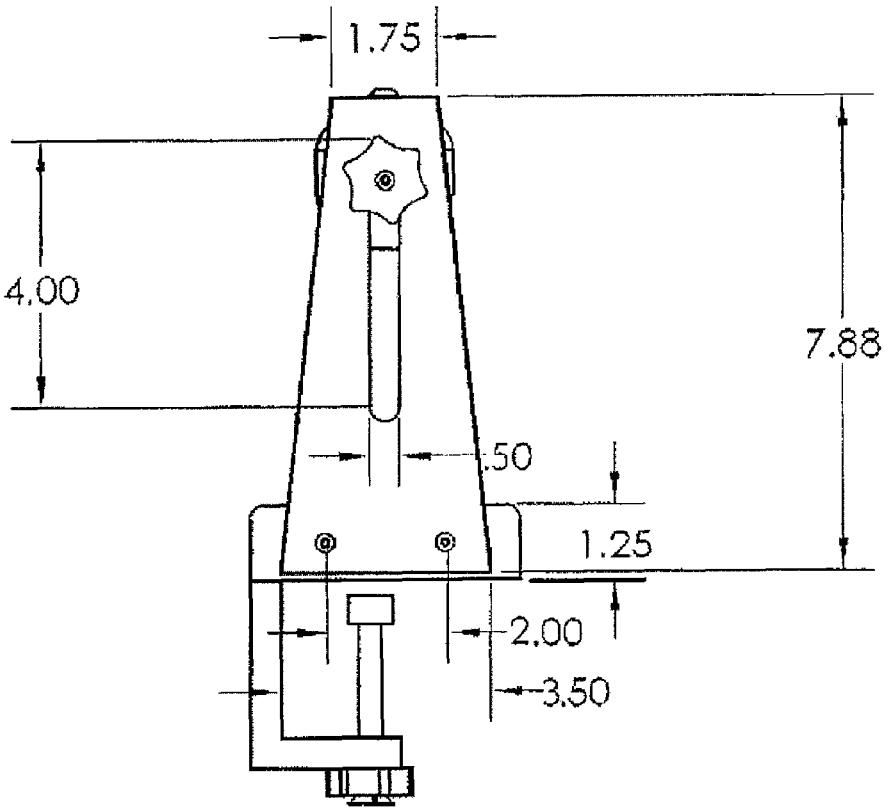
Figure 15A:
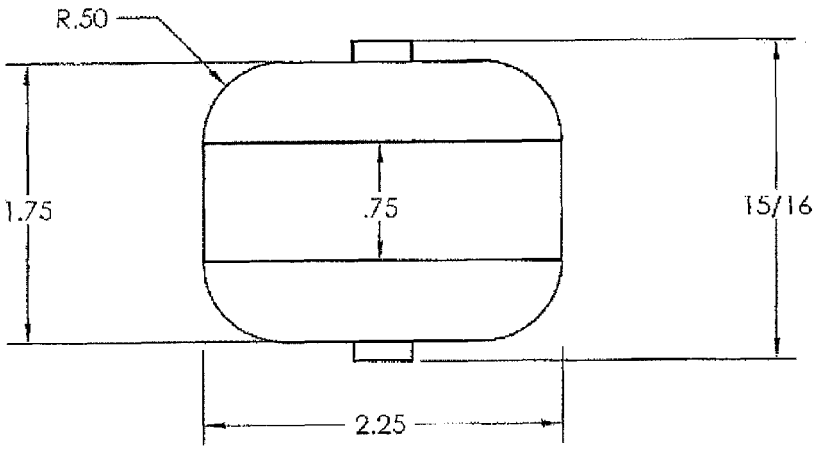
FIGS. 15A-15B are dimensioned views of a massage wheel according to one embodiment of the invention.
Figure 15B:
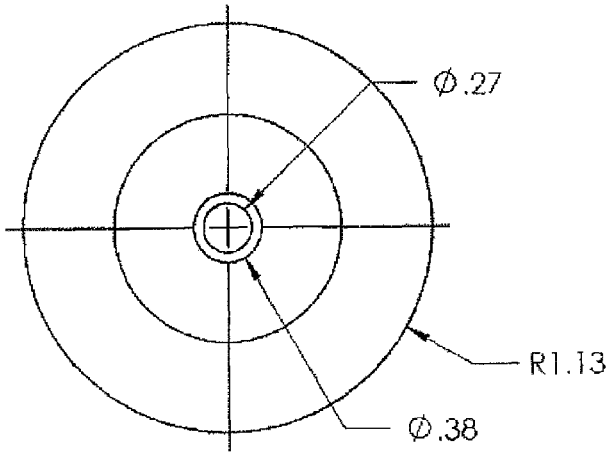

As shown in FIG. 14B, the centers of the massage rollers are about 3 inches apart, and the starting position between the rollers is 0.50 inches. In one embodiment, this spacing is adjustable using the throat adjustment screw. In a preferred embodiment, a "one size fits all" approach is used where starting spacing is the same but pressure applied varies based on the size of the user's limb and position on the flex plates of the roller wheel and roller wheel bracket. The rollers preferably have a 2.25-inch diameter. The base preferably has a length of 4.5 inches in a direction of use of the massage rollers. As shown in FIG. 14C, the massage apparatus base width is about 6.25 inches. In a preferred embodiment, the leaf springs are substantially trapezoidal as shown in FIG. 14D. The measurements and configuration of that trapezoid may change according to pressure requirements, since the thickness, size, and shape of the flex plate substantially affects the pressure of the roller wheel. FIGS. 15 A and B depict a preferred embodiment of the massage apparatus rollers. In a preferred embodiment, each roller has a 0.75-inch flat contact area that contacts the user during use of the massage apparatus. Other size roller wheels are envisioned.

Figure 16:
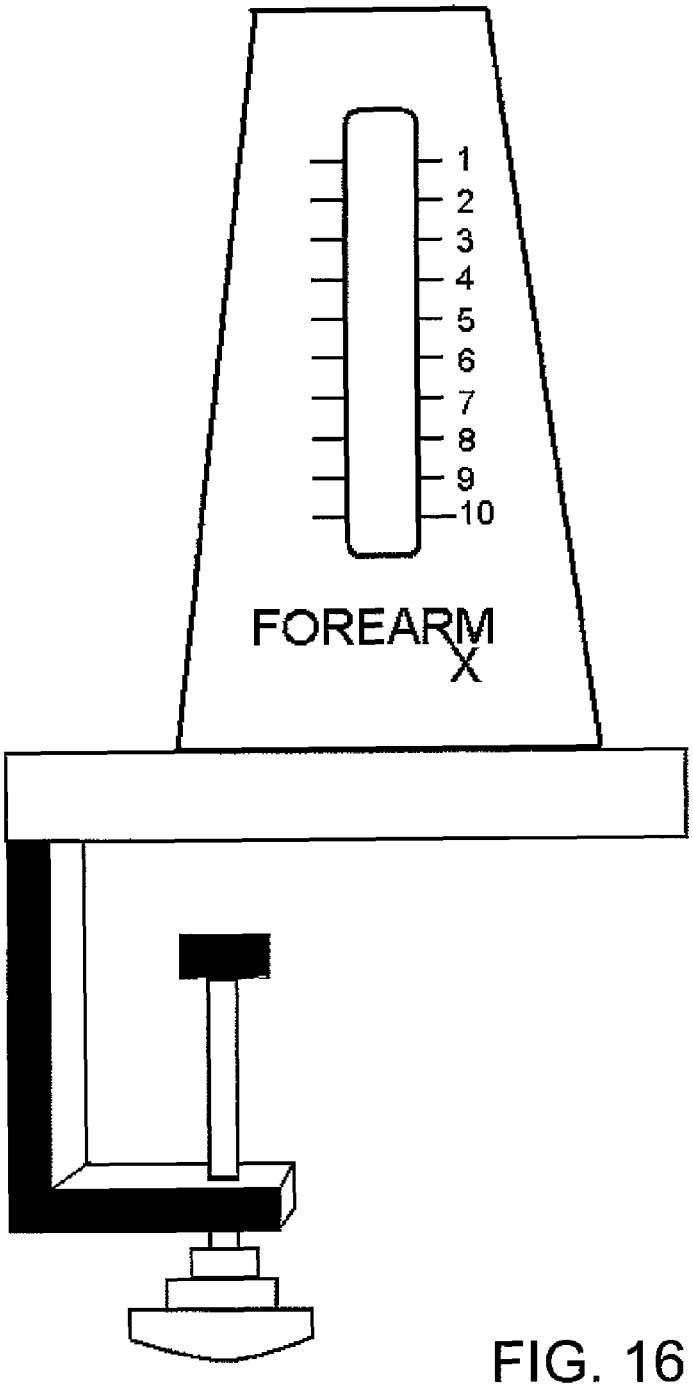
FIG. 16 is a side view of the massage apparatus including an adjustment scale for the massage apparatus according to one embodiment of the invention.

FIG. 16 depicts a label for at least one leaf spring of the massage apparatus shown in FIG. 14A. The scale relates to the force applied by the rollers as the roller assemblies are moved. Other scales are envisioned. In one embodiment, a scale is etched, screen-printed, affixed with a decal, or molded into the leaf spring. The massage apparatus works by creating massage and trigger point pressure using roller wheels or roller blades as contact points along the patient's limb. This system is self-administered by the user and is adjustable to accommodate limb size from very small to very large. Tension can be increased or decreased to accommodate a patient's comfort and ability to handle therapeutic pressure on the limb. In the preferred embodiment, the massage apparatus is affixed to a table edge. The user then places a body part such as a wrist or forearm between the roller wheels. The starting and finishing positions are with the roller wheels on the wrist, but can vary based on the individual needs of the user. The user either in a seated or standing position pushes his or her wrist/forearm through the opposing roller wheels, experiencing pressure against both the anterior and posterior forearm muscles. The user continues pushing his/her forearm through the opposing roller wheels until the roller wheels reaches at least the bony landmarks of the lateral and medial epicondyles. The user then slowly pulls his/her arm back through the opposing roller wheels, experiencing pressure once again against both the anterior and posterior forearm muscles.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps that perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

I claim:

1. A massage apparatus comprising:

a base plate;

a first tension plate bendably affixed at a first end to the base plate;

a second tension plate bendably affixed at a second end of the base plate opposite the first tension plate;

a first massaging element coupled to the first tension plate remote from the base plate;

a second massage element coupled to the second tension plate remote from the base plate facing the first massaging element; and a variable adjuster configured to vary at least one of a distance between the first and the second massage elements and a pressure applied by the massage elements, wherein the variable adjuster is configured so that the pressure applied by the massage elements is adjustable given any distance between the first and the second massage elements, wherein the variable adjuster comprises:

a first threaded rod coupling the first tension plate and the second tension plate, whereby rotating the first threaded rod causes the first tension plate and the second tension plate to move toward and away from each other, and a second threaded rod spaced apart from and parallel to the first threaded rod coupling the first tension plate and the second tension plate, whereby rotating the second threaded rod varies the pressure applied by the massage elements.

2. The massage apparatus according to claim 1, wherein the variable adjuster comprises a slot in each of the first tension plate and the second tension plate, the respective slots extending along a length of each of the first tension plate and the second tension plate substantially perpendicular to the base.

3. The massage apparatus according to claim 2, further comprising a clamp assembly configured to clamp the massage apparatus to a surface.

4. The massage apparatus according to claim 3, wherein the clamp assembly is at least one of a c-clamp and a suction assembly.

5. The massage apparatus according to claim 2, wherein the pressure applied by the massage elements increases as the massage elements are adjusted in their respective slots towards the base.

6. The massage apparatus according to claim 5, further comprising a scale arranged on at least one of the tension plates, the scale based at least in part on the pressure applied by the massage elements.

7. The massage apparatus according to claim 2, wherein at least one of the massage elements is a roller wheel.

8. The massage apparatus according to claim 7, wherein the roller wheel further comprises a foam cover.

9. The massage apparatus according to claim 2, wherein the first tension plate and the second tension plate extend substantially perpendicularly from the base plate.

10. The massage apparatus according to claim 1, wherein the variable adjuster is further configured to fix the at least one of the distance between the first and the second massage elements and the pressure applied by the massage elements.

11. A massage apparatus comprising:

a base plate;

a first tension plate that extends substantially perpendicularly from the base plate and is bendably affixed at a first end to the base plate;

a second tension plate that extends substantially perpendicularly from the base plate and is bendably affixed at a second end of the base plate opposite the first tension plate;

a first massaging element coupled to the first tension plate remote from the base plate;

a second massage element coupled to the second tension plate remote from the base plate facing the first massaging element; and a variable adjuster comprising a slot defined in each of the first tension plate and the second tension plate, the respective slots extending along a length of each of the first tension plate and the second tension plate substantially perpendicular to the base and configured to vary at least one of a distance between the first and the second massage elements and a pressure applied by the massage elements, wherein the variable adjuster is configured so that the pressure applied by the massage elements is adjustable given any distance between the first and the second massage elements, wherein the variable adjuster comprises a first threaded rod coupling the first tension plate and the second tension plate, whereby rotating the first threaded rod causes the first tension plate and the second tension plate to move toward and away from each other, wherein the variable adjuster further comprises a second threaded rod coupling the first tension plate and the second tension plate, whereby rotating the second threaded rod varies the pressure applied by the massage elements, wherein each of the first tension plate and the second tension plate comprises a bend configured to separate the ends of the first tension plate and the second tension plate opposite the base plate wider than the base plate.

12. A massage apparatus comprising:

a base plate;

a first tension plate bendably affixed at a first end to the base plate, the first tension plate defining a first slot extending along a longitudinal length of the first tension plate substantially perpendicular to the base plate;

a second tension plate bendably affixed at a second end of the base plate opposite the first tension plate, the second tension plate defining a second slot extending along a longitudinal length of the second tension plate substantially perpendicular to the base plate;

a first massaging element longitudinally moveably coupled to the first tension plate at the first slot with a first screw element;

a second massage element longitudinally moveably coupled to the second tension plate at the second slot with a second screw element, facing the first massaging element; and wherein the pressure applied by the massage elements is adjustable by varying a distance between the first and the second massage elements and the base plate by slideably moving each massage element and its respective screw element longitudinally along its respective slot, whereby loosening the respective screw element allows the respective massage element to longitudinally traverse its respective slot and tightening the respective screw element locks the respective massage element at a longitudinal location in its respective slot.

* * * * *